US006015354A

United States Patent [19]

Ahn et al.

[11] Patent Number: 6,015,354

[45] Date of Patent: Jan. 18, 2000

[54] GOLF CLUB WITH ADJUSTABLE TOTAL WEIGHT, CENTER OF GRAVITY AND BALANCE

[76] Inventors: Stephen C. Ahn, 8809 S. Lea Ct., Fairfax, Va. 22031; Suh Yong Lee, 4118 Amesbury La., Durham, N.C. 27757

[21] Appl. No.: 09/035,031

[22] Filed: Mar. 5, 1998

[51] Int. Cl.[7] ..... A63B 53/08

[52] U.S. Cl. ..... 473/256; 473/334; 473/350; 473/336; 473/341; 473/339

[58] Field of Search ..... 473/334, 335, 473/336, 337, 338, 339, 290, 291, 226, 256, 350, 341

[56] References Cited

U.S. PATENT DOCUMENTS

| | | | |
|---|---|---|---|
| 2,155,830 | 4/1939 | Howard . | |
| 2,592,013 | 4/1952 | Curley | 473/333 |
| 2,652,256 | 9/1953 | Thomas | 473/333 |
| 3,220,733 | 11/1965 | Saleeby | 473/335 |
| 3,419,275 | 12/1968 | Winkleman | 473/335 |
| 3,606,327 | 9/1971 | Gorman | 473/337 |
| 3,979,122 | 9/1976 | Belmont | 473/336 |
| 4,135,720 | 1/1979 | Lancellotti . | |
| 4,869,507 | 9/1989 | Sahm | 473/337 |
| 5,013,041 | 5/1991 | Sun et al. | 473/336 |
| 5,230,509 | 7/1993 | Chavez | 473/334 |
| 5,244,210 | 9/1993 | Au | 473/336 |
| 5,366,222 | 11/1994 | Lee | 473/333 |
| 5,482,282 | 1/1996 | Willis | 473/342 |
| 5,683,309 | 11/1997 | Reimers | 473/337 |

*Primary Examiner*—Sebastiano Passaniti
*Attorney, Agent, or Firm*—Alfred F. Hoyte, Jr.

[57] ABSTRACT

Improved golf club heads including irons, woods and putters have built-in provisions to change the weight of the golf club head including a way to increase, decrease or adjust the position and the amount of weights in a selected golf club head so as to enable the player to adjust the club's center of gravity, total club weight, and balance of the club and to tailor the club to compensate for an individual's style of swing, physical characteristics and skill level as a way of improving the golfer's accuracy and the distance of his shots.

3 Claims, 7 Drawing Sheets

1
2
6
10
5
53
4
8
11
7
3
9

1
8
2
6
5
10
11
12
7
13

10
12
11
11
12
13
13
12
11
11
14
12

1
2
17
5
16
19
8
53
4
15
3

1
21
20
17
16
19
23
15
22

1
8
2
17
16
15

17
16
15
18
17
15
16
18

Fig. 11
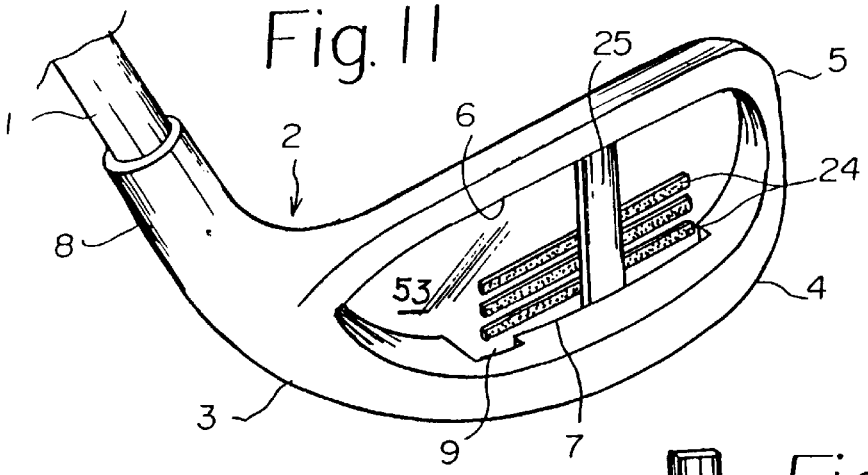
Fig. 13
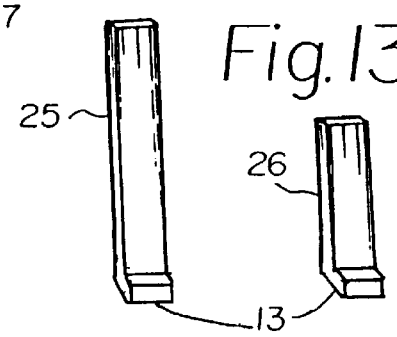
Fig. 12
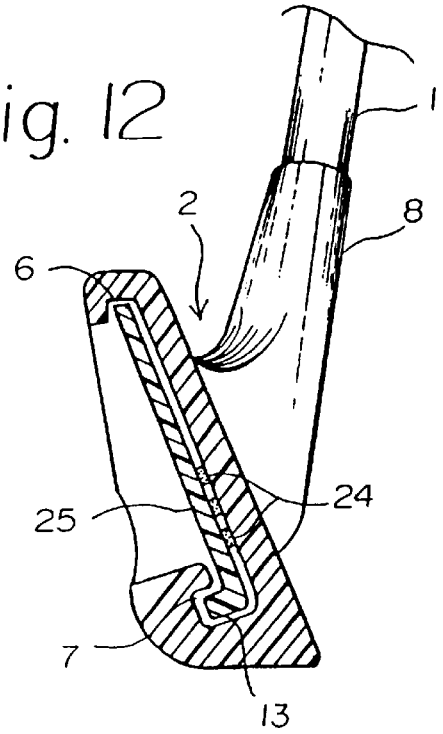
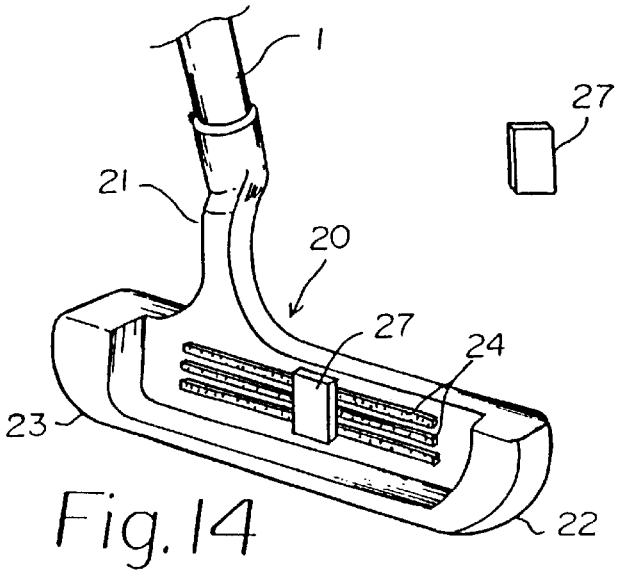
Fig. 14

1
2
5
8
53
4
3
49
52
50
51

1
49
37
38
50
40
39
52
51

3, 23, 39
52
51
50
49

1
21
36
22
23
49
50
51
52

GOLF CLUB WITH ADJUSTABLE TOTAL WEIGHT, CENTER OF GRAVITY AND BALANCE

FIELD OF THE INVENTION

This invention relates generally to the field of golf and, more particularly, to golf clubs of improved design including the heads of irons, woods, and putters. More specifically, to an improved method and technique for placement of weights in the head of a golf club so that the total club weight, center of gravity and weight distribution in the head of the club can be modified to suit a player's physical characteristics and ability.

BACKGROUND OF THE INVENTION

It is well known that a golfer's game is greatly affected by the golf clubs used. For this reason golfers spend considerable time in selecting the golf clubs that is best suited to their techniques of play. Furthermore, an individual's golf swing may vary slightly or dramatically from week to week, and the golfer is limited to his or her clubs that were selected based on his or her swing at a given point in time.

Among the factors that a golfer considers in selecting a set of clubs are its swing weights, weight distribution of the club head and the center of gravity of the club. These same criteria are considered by golf club manufacturers in their unsuccessful efforts to customize their product to satisfy individual requirements. However, because clubs are designed for esthetics rather than the individual golfer's needs and abilities, it has not been feasible to find or assemble a set of clubs which matches any one individual golfer's psychological, physical and skill requirements perfectly all the time.

Consequently, most of the commercially available clubs are weighted within a narrow range so that they can be used by the vast majority of golfers. As a result, a very small adjustment in the weight of the club is needed to change the center of gravity and the total weight of the club head.

It is well known that the weight of the golf club affects the speed of swing that in turn controls the distance of a shot. The faster the speed of the club head at the time of impact with the ball, the longer the length of a shot will result. The club head speed is governed by the strength of the player and the weight of the club head. For a given player, the weight of a club head is; therefore, the governing factor for obtaining the maximum possible distance.

Unfortunately, there is no way to adjust the weight of a club short of buying a new set of clubs. For example, the club designed for six feet five-inch tall person is also used by a player with much less stature and strength. This is particularly true with the clubs intended for juniors, and in some extent seniors and women players. The golf clubs are, for the most part, made for one "standard" and "average" person. Moreover, the strength of a golfer may change as he or she gets older, and weighing of the club will need to change also. The advantage of adjustability of the club to suit each player's need becomes obvious. The subject invention addresses a method to adjust the total clubhead weight of a given club based on a player's physical characteristics and skill level to achieve the best possible golf shots.

Similarly, the location of the center of gravity of a club head has a significant effect on the driving characteristics of a golf shot, particularly with less skilled and less experienced golfers. Location of the center of gravity for a club is very important since it can control the trajectory of the ball.

Unlike an expert who can control the flight of the ball by controlled rotation of his hands to cause a spin to be imparted to the ball, a less skilled golfer relies on attempting to hit the ball so that impact with the club head is made at the sweet spot that is generally located along a vertical line which runs directly opposite the center of gravity of the head. A small change in the center of gravity can influence the tendency of a shot to hook or slice. A golf shot can hook or slice depending on the training and acquired habits of a player. If an adjustment of the center of gravity of a club is possible, the tendency of hooking or slicing a shot may be compensated by making a small change of the center of gravity without modifying the swing. Some manufacturer varies the center of gravity according to the loft of the club. Nevertheless, no club design allows adjustment of the center of gravity for a given club. This invention addresses a method of adjusting the center of gravity of a given club.

Another important feature in the construction golf club's club head is the distribution of weight. Depending on the weight distribution, a golf club can influence the distance of a shot and tendency to hook or slice the ball for a given skill level of a player. Therefore, a manufacturer will design the clubs adjusted to the skill of a player. For example, an iron designed for a skilled player usually has most of the weight centered behind the optimal hitting area on the club surface, or sweet spot. However, this type of club does not offer much margin for error. For majority of players, the manufactures offer other designs mainly depending on how the weight is distributed. A perimeter-weighted, heel-toe weighted, or sole-weighted irons are some typical examples. The perimeter-weighted clubs have a larger sweet spot, allowing more margin for error. Since all the weight does not have to be centered directly behind the sweet spot for a good shot to come off, distributing the club head's weight around the perimeter will help to compensate for a mis-hit. Other manufactures distribute the majority of the weight in the heel and toe of the clubhead, book ending the sweet spot. The theory is that less-skilled players mis-hit most of their shots in the heel or toe, so when they do, the weight is there to compensate. Furthermore, some clubs have a high concentration of weight toward the sole of the club. Locating the majority of clubhead's weight under the equator of the ball, a player will have easier time to get the ball airborne. In the case of putters, most putters are heel-toe weighted, with very little weight directly behind the ball. All these clubs mentioned above have fixed weight distribution, and there is no way to change the original design. Only commercially available method to modify the weight distribution is to attach a strip of thin tape made with lead.

In the past, many prior art proposals have been made for weight adjustment and, accordingly, the customizing of a golf club to one's swing has been made. For example, U.S. Pat. No. 5,297,794 to Lu discloses club head with weight furnishing 20 to 25 percent of the club head mass. This proposal lacks any feature of adjusting weight distribution, and more importantly, in practical purposes, it is not necessary to change such a large percentage of weight to achieve the desired purpose.

Other golf clubs with adjustable weighing representative of the prior art are disclosed in U.S. Pat. Nos. 4,607,846 to Perkins, 5,385,348 to Wargo, and 4,869,507 to Sahm. These patents all provide adjustable swing weight and weight distribution. The U.S. Pat. No. 4,607,846 provides two elongated openings extending directionally between the toe and heel with threaded weights. This arrangement appears to satisfy the adjustability requirement of both total club head weight and weight distribution. However, it is too complicated in design to apply to practical uses. The U.S. Pat. No. 5,385,348 and No. 4,869,507 have provisions for one or more replaceable inserts of varying weight to adjust the total weight and weight distribution of a club. Although elegant, it lacks simplicity and infinitely adjustable features of the subject invention.

There have been other attempts to add the adjustable weight feature to a golf club head, mainly to a wood type golf club in the prior patent art. For example, U.S. Pat. No. 5,013,041 to Sun shows a wood type golf club which has a pair of parallel longitudinal chambers placed behind the face plate. By placing a set of weight members in the chamber, the club head weight and the center of gravity of the club may be varied. U.S. Pat. No. 5,518,243 to Redman features a weight distributor which includes an array of apertures to receive spherical weights. Although both of these prior art permit change of club head weight and center of gravity, they apply only to the wood type of golf club and lack simplicity and infinitely an adjustable feature of the subject invention.

There have been many other attempts to add weight adjustment features to a golf club head, particularly to a putter head. Bushner U.S. Pat. No. 4,895,371; Anderson U.S. Pat. No. 4,962,932; Au U.S. Pat. No. 5,244,210; and Bland U.S. Pat. No. 5,688,189 are some of the examples. However, all these prior arts are for the putter type of golf club, and lack universal applicability to other type of golf clubs such as iron, wood and wedge.

SUMMARY OF THE INVENTION

Accordingly, it is a primary object of the present invention to provide an improved golf club with provision to accept a small weight addition without the complicated mechanism or design. The weight addition can be accomplished without requiring any specialized tools.

Another objective of the present invention is to provide a golf club weight addition that can also easily be repositioned to alter the weight distribution and the center of gravity depending on the player's physical condition of the day.

A still further object of the present invention is to provide a golf club that can alter the club head weight without changing the basic club design currently available in the market.

Another objective of the invention is to provide the unconventional clubs such as the clubs for juniors, seniors, and women with variable weight as well as the adjustable weight distributional capabilities to accommodate the large variability of the player's physiological makeup. To achieve the foregoing and other objectives, and in accordance with the purposes of the present invention as described herein, an improved golf club is provided for efficiently striking a golf ball so as to allow shot-making with better accuracy and increased resulting distance. With these inventions, an infinite number of adjustments can be made to vary the club head weight, the center of gravity of a club as well as the weight distribution of a club. A player can, by making a simple adjustment to the club, tailor-make the club for his or her needs and abilities.

BRIEF DESCRIPTION OF THE DRAWINGS

The accompanying drawing incorporated in and forming a part of the specification, illustrated several aspects of the present invention and together with the description serves to explain the principles of the invention. In the drawing:

FIG. 11 is a perspective view of an iron golf club head made in accordance with the forth embodiment of the present invention.

FIG. 12 is a cross-sectional view of an iron golf club shown in FIG. 11.

FIG. 13 is a perspective views of weights attachments used in the embodiment viewed in FIG. 11 and FIG. 14.

FIG. 14 is a perspective view of putter head made in accordance with the fourth embodiment of the present invention.

DETAILED DESCRIPTION OF THE INVENTION

Figure 1:
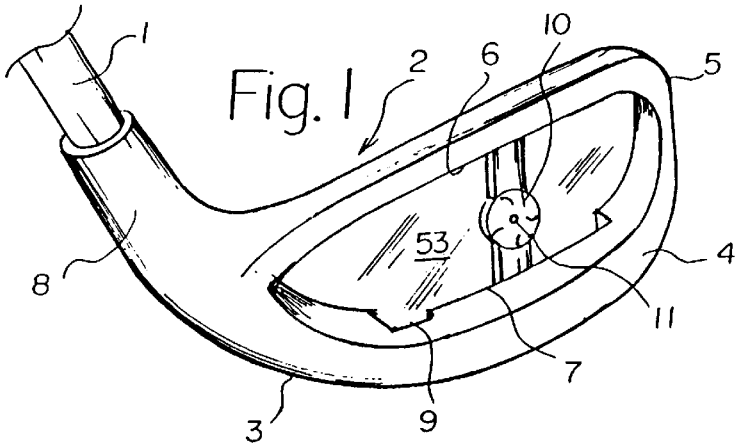
FIG. 1 is a perspective view of a golf club head made by present invention.
Figure 2:
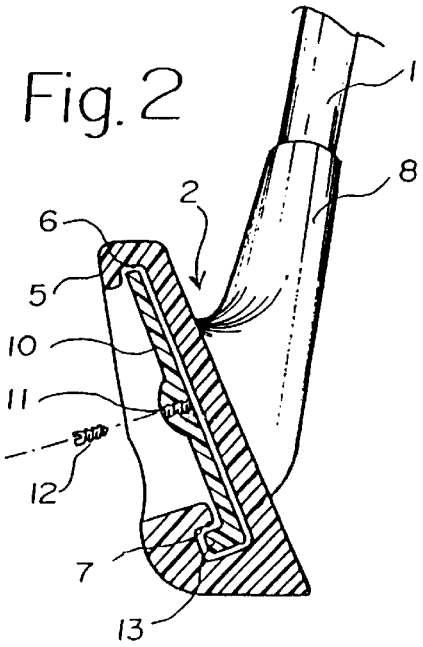
FIG. 2 is a cross-sectional view of the golf club made by the present invention.
Figure 3:
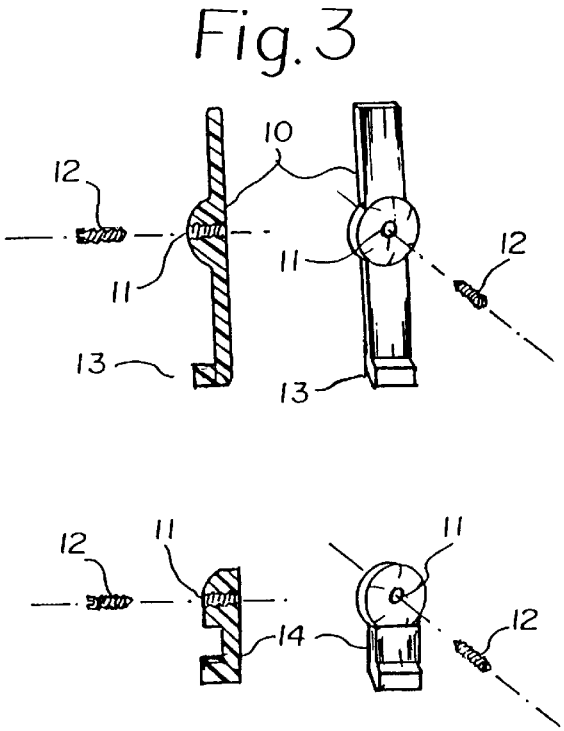
FIG. 3 is perspective and cross-sectional views of the full height weight attachment and half height weight attachment of the present invention.

Reference is now made to the drawing figures showing the improved golf club heads 2, 20, 36, 37 of the present inventions to alter the total club head weight and the center of gravity. As shown in FIGS. 1–3, the iron golf club head 2 includes shaft 1, hosel 8, toe portion 4, heel portion 3, and perimeter 5. The weights 10, or 14 is mounted on the surface 53 directly behind the golf ball striking face of the body portion of the perimeter weighted iron. Weight 10 is the full-height design, and weight 14 is the half-height design. Both designs have a small rectangular extension 13 which mates with a rectangular notched slot 7 at the bottom of the club head. Slot 7 has an entrance section 9 to accept the rectangular notched extention 13 of weight. The weight 10 is securely held to the iron club head by a set screw 12 and threaded tap 11. As the set screw is turned toward the club head surface, both end of the weight 10 will push against the notch of the club head 6 and 7 thus securely fastening the weight to the club head. When it is desired to change the position of the weight to alter the center of gravity of the club head, the set screw 12 is loosened. The weight can be slid along the slot 7 and slot 6 either forward toward the toe 4 or backward toward the heel 3 of the club head and then securely tighten the screw 12. The total mass of the weight 10 can be varied by fabricating the weight in different shape or thickness or both. Alternatively, the weight 10 can be varied by fabricating it with materials of different density. For example, the weight 10 can be fabricated with plastic, aluminum, titanium, steel or lead alloys. The weight can be either full height 10 or half height 14 depending on the weight requirement of the player.

Figure 4:
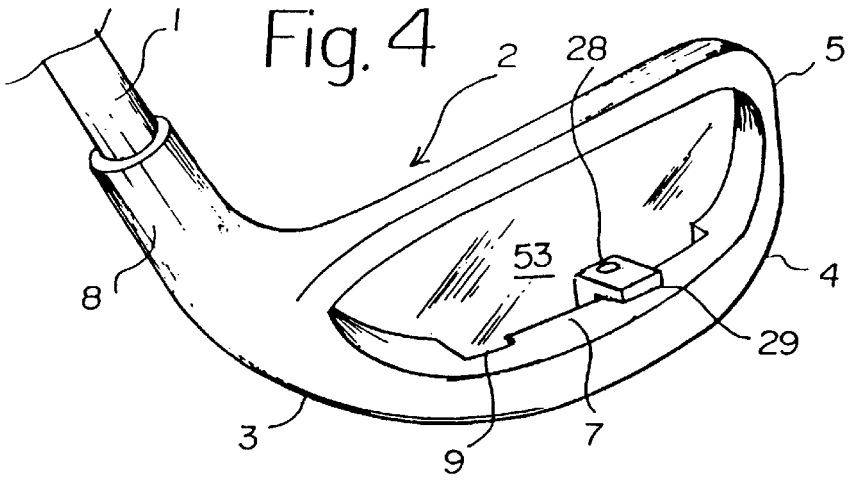
FIG. 4 is a view similar to FIG. 1 to show the second embodiment of the present invention in which weight attachment of alternate design is illustrated.
Figure 5:
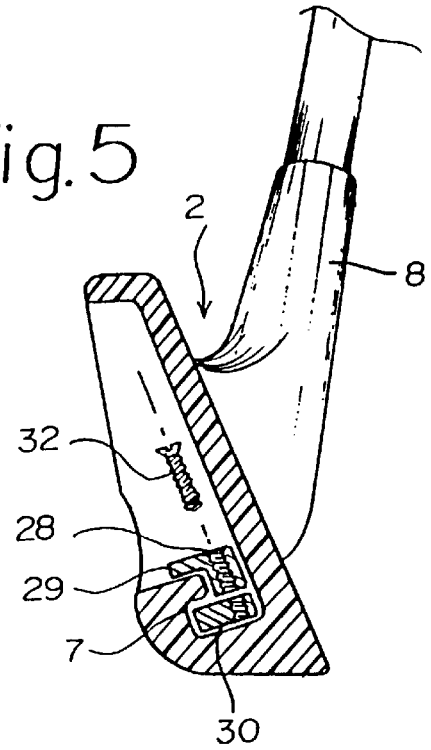
FIG. 5 is a cross-sectional view of the golf club shown in FIG. 4 illustrating attachment of weight of the second embodiment of the present invention.
Figure 6:
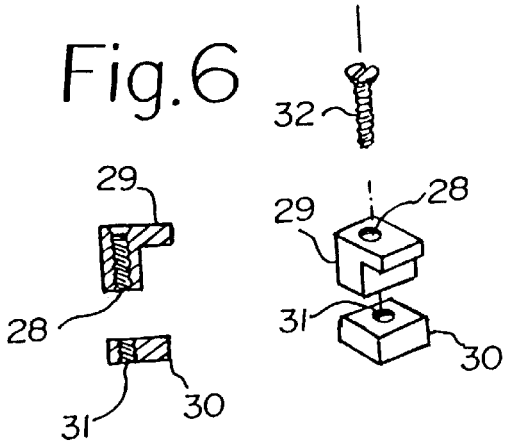
FIG. 6 is a perspective and cross-sectional view of the weight attachment shown in FIG. 4 and FIG. 6.

An alternate embodiment of attaching weight to the iron golf club head 2 is illustrated in FIGS. 4–6. The weight assembly consisted of a top section 29, a bottom section 30 and a fastening screw 32. The bottom section has a tapped hole 31 to receive the threaded screw 32. The top section has a counter sunk hole 28 in the center to accept the screw 32. The weight assembly is fastened to the iron club head 2 as illustrated in FIG. 4 and FIG. 5. After the bottom section 30 is inserted in the slot 9 and then slot 7 of the club heads the top section 29 is mated with the bottom section 30 and tightened together with the screw 32. When it is desired to change the position of the weight to alter the center of gravity, the screw 32 is loosened. The weight assembly can be slid along 7 either forward toward the toe 4 or backward toward the heel 3 of the club head and then securely tighten the screw 32. Total mass of the weight assembly can be varied by fabricating it with different material such as aluminum, steel, titanium, plastic or lead alloys and by changing width of the weight sections.

Figure 7:
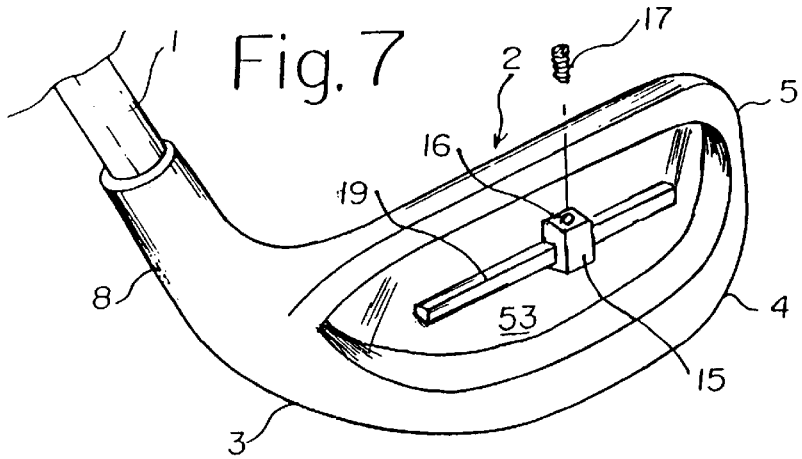
FIG.7 is perspective view of an iron golf club head made in accordance with another embodiment of the present invention.
Figure 8:
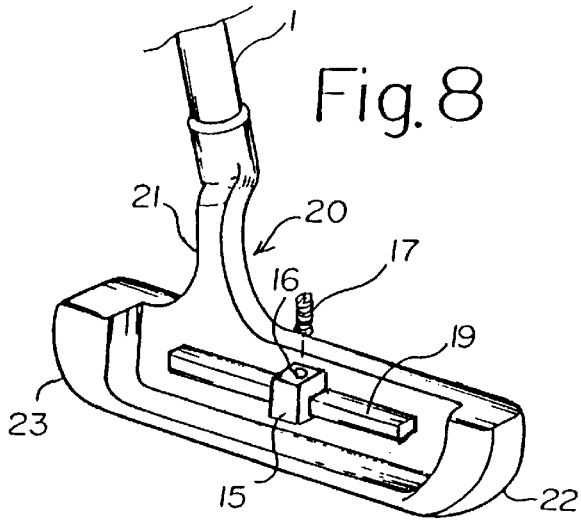
FIG. 8 is a perspective view of a putter head made in accordance with another embodiment of the present invention.
Figure 9:
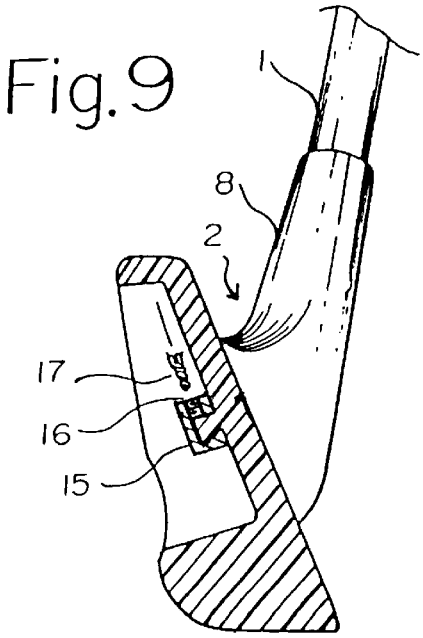
FIG. 9 is cross-sectional view of an iron golf club shown in FIG. 7.
Figure 10:
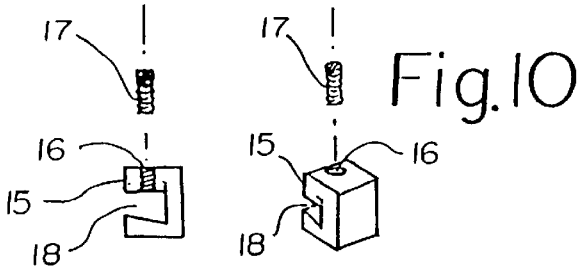
FIG. 10 is a side plan view and a perspective view of the weight attachment used in the embodiment viewed in FIG. 7 and FIG. 8.

FIGS. 7–10 illustrate an alternate embodiment of attaching a weight to the golf club head to alter the total club head weight or the center of gravity of a golf club. A weight 15 is attached to either perimeter weighted or forged iron club head 2 or a putter head 20 having a sharp-edged trapezoidal shaped rail 19 along the length of the club head on a back side of the hitting surface 53 as illustrated in FIG. 7 for the iron club head and FIG. 8 for the putter club head. The weight 15 having a trapezoidal slot 18 which mates perfectly with the rail 19 is mounted on the club head and securely attached to the rail by tightening a set screw 17 into the threaded tap hole 16. By sliding the weight along the rail toward the toe 4 of an iron club or the toe 22 of a putter and toward the heel 3 of an iron club or heel 23 of a putter, the center of gravity can be adjusted. The total mass of the weight 15, and consequently the club head weight, can be varied by either changing the size of the weight 15 or varying the density of the weight.

FIGS. 11–14 illustrate yet another embodiment of attaching a weight to the golf club head to alter the total club weight or the center of gravity of a golf club. A full height weight 25 or a half height weight 26 is attached to either an iron golf club 2 or a putter 20 by means of a set of magnets, 24. A magnet assembly similar to the type commonly used in the furniture industry consisting of array of thin permanent magnet strips 24 may be fastened to the back of the hitting surface of an iron club 53 or a putter. Set of weights 25, 26, or 27 for a putter fabricated with magnetic materials such as steel can be attached to the magnet assembly and consequently to the golf club head. In the case of iron club head, the magnetic force acting on the weight to hold it in place may not be strong enough as the club head strikes a golf ball at very high speed. To prevent the weight from being detached whenever the club strikes a ball, the weights 25 or 26 will have a small rectangular extension 13 that mates with a rectangular notched slot 7 at the bottom of the club head. Since a putter does not strike a ball with high velocity, the magnetic force alone will be sufficient to keep the weight 27 on the putter head at all times. By sliding the weight toward the toe 4 of an iron club or the toe 22 of a putter and toward the heel 3 of an iron club or the heel 23 of a putter, the center of gravity can be adjusted. The total mass of the weight 25, 26, or 27, can be varied by either changing the size of the weight or varying the density of the weight.

Figure 15:
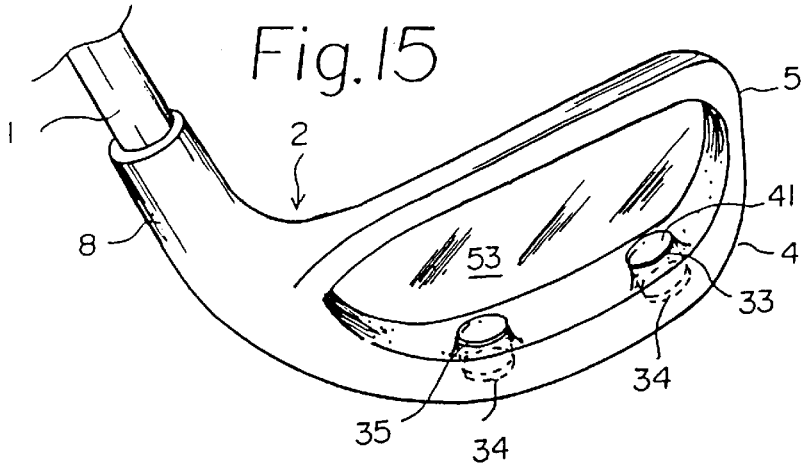
FIG. 15 is a perspective view of an iron golf club made in accordance with the fifth embodiment of the present invention.
Figure 17:
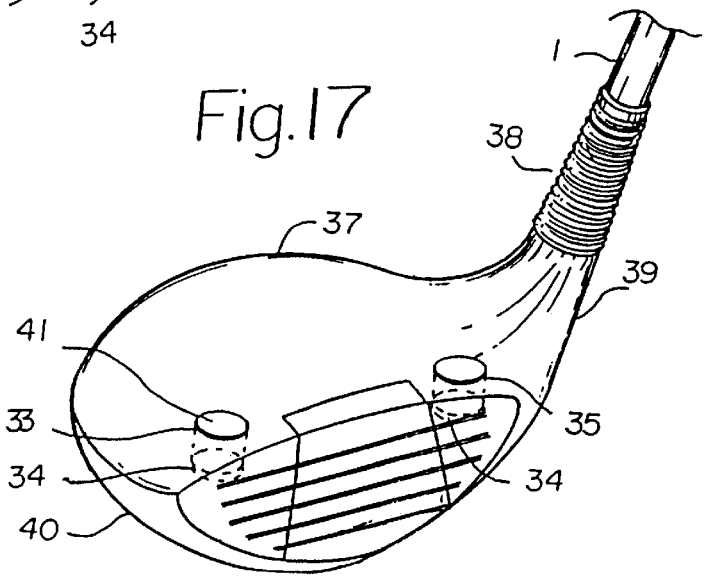
FIG. 17 is a perspective view of wood club head made in accordance with the fifth embodiment of the present invention.
Figure 16:
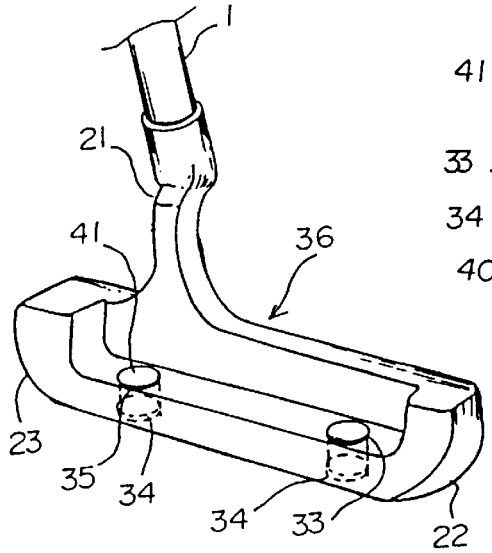
FIG. 16 is a perspective view of putter head made in accordance with the fifth embodiment of the present invention.
Figure 18:
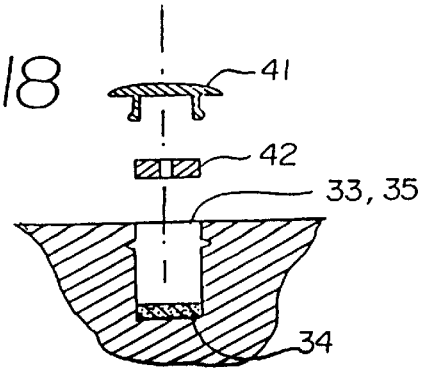
FIG. 18 is the cross-sectional view of a weight holding pocket, a weight, and a cap employed in the embodiment viewed in FIG. 15, FIG. 16 and FIG. 17.

Still another embodiment of adding the weight to a club and adjust the club weight distribution is illustrated in FIGS. 15–18. For an iron club, preferably a perimeter weighted club head 2, small cylindrical pockets 33 and 35 are placed on the heel 3 and toe 4 ends of the club head as shown in FIG. 15. Similarly, small cylindrical pockets 33 and 35 are placed in the heel 23 and the toe 22 ends of a putter head as illustrated in FIG. 16. Same type of cylindrical pocket can be placed in the heel 39 and the toe 40 of a wood club head as shown in FIG. 17. A thin disc of permanent magnet 34 is cemented in the bottom surface of the pocket as shown in FIG. 18. A weight shaped similarly to a washer 42 having magnetic property such as steel may be placed in the pocket as additional head weight or changing the weight distribution. A cap 41 made with a plastic material and fashioned to fit snugly to the pockets 33 and 35 may be placed to cover the hole preventing any unintended loss of the weight.

Figure 19:
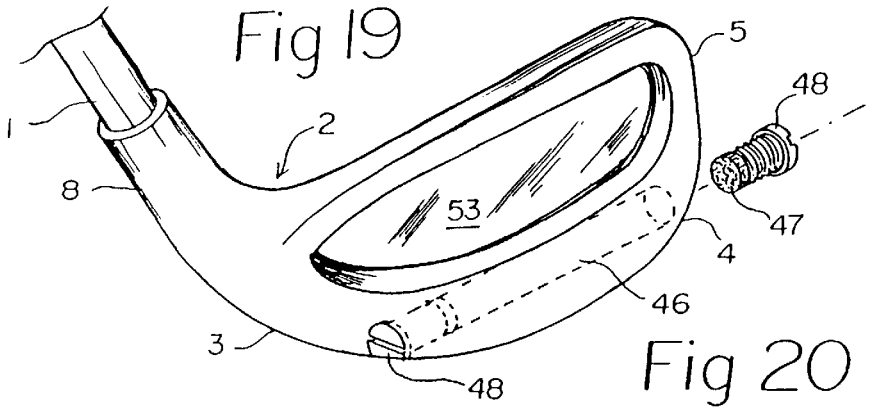
FIG. 19 is a perspective view of an iron golf club made in accordance with the sixth embodiment of the present invention.
Figure 20:
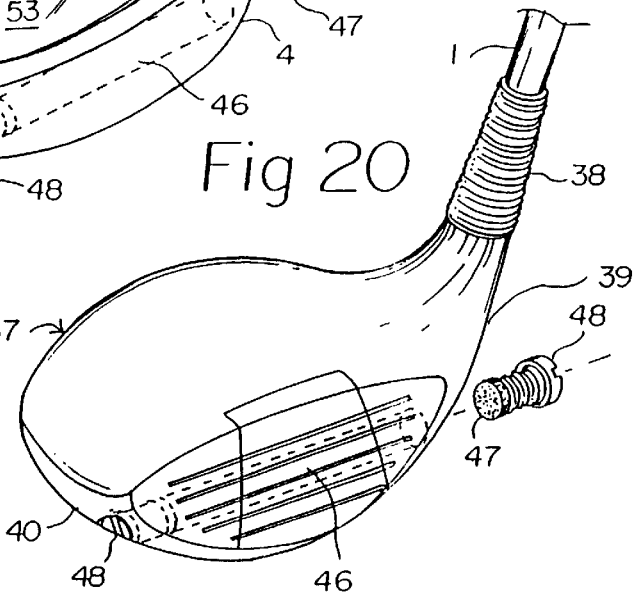
FIG. 20 is a perspective view of wood club head made in accordance with the sixth embodiment of the present invention.
Figure 21:
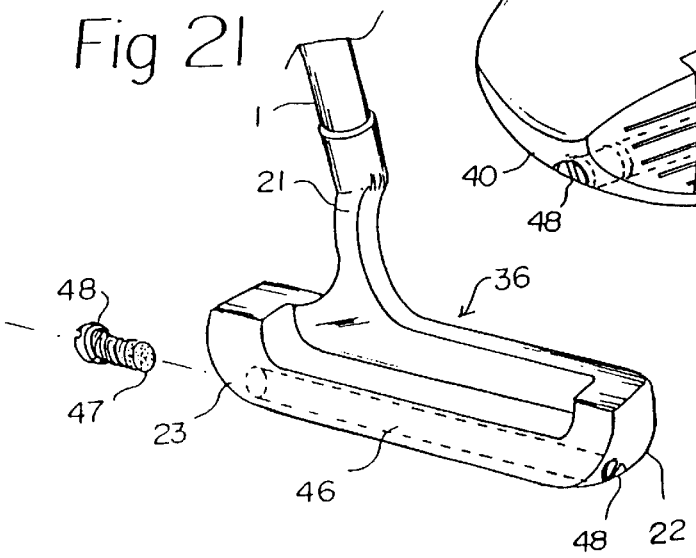
FIG. 21 is a perspective view of putter head made in accordance with the sixth embodiment of the present invention.
Figure 22:
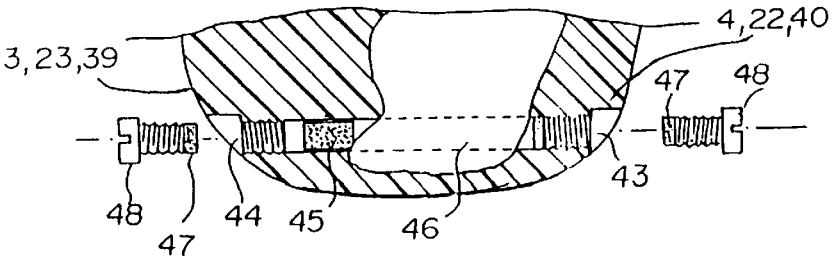
FIG. 22 is an enlarged cross-sectional view of the bore hole cavity, a threaded cap for the cavity tipped with a magnet employed in the embodiment viewed in FIG. 19, FIG. 20 and FIG. 21.

Another embodiment to provide the adjustable feature of the center of gravity, club head weight, and weight distribution to the golf clubs of iron 2, wood 37, and putter 36 is to provide above-mentioned clubs with a bore hole 46 longitudinally drilled from toe to heel of the club, as illustrated in FIGS. 19–22. FIG. 19 illustrates an iron club head 2 showing location of the bore hole 46. Similarly, FIG. 20 and FIG. 21 illustrate location of the bore hole 46 in a wood club head 37 and a putter 36, respectively. As detailed in FIG. 22, the holes 43, 44 are capped at both ends with threaded caps 48 tipped with a permanent magnet 47. Steel weight 45 of various lengths may be inserted to either/or both ends of the holes 43, 44 for adding more weight to the club head or adjusting the center of gravity of the club.

Figure 23:
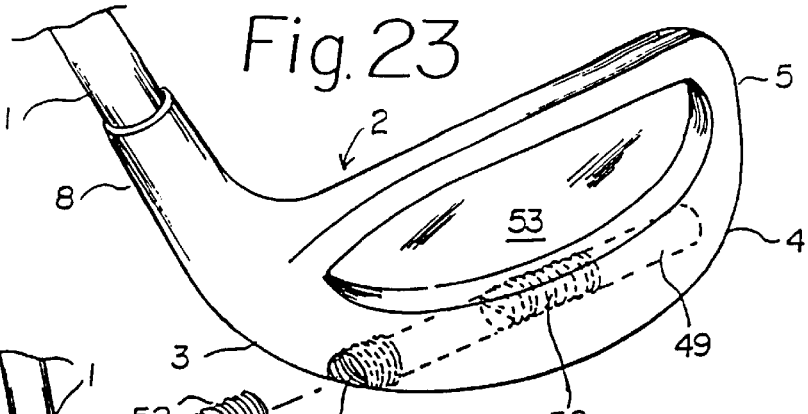
FIG. 23 is a perspective view of an iron golf club made in accordance with the seventh embodiment of the present invention.
Figure 24:
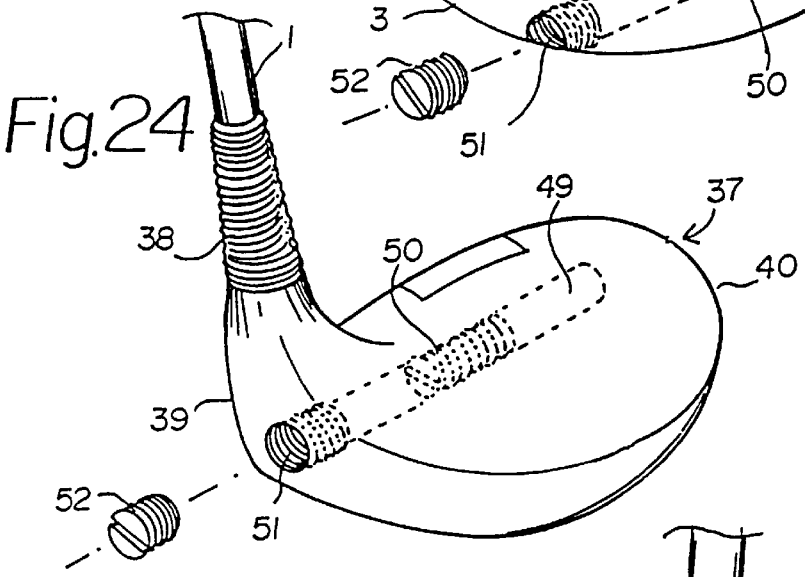
FIG. 24 is a perspective view of wood club head made in accordance with the seventh embodiment of the present invention.
Figure 26:
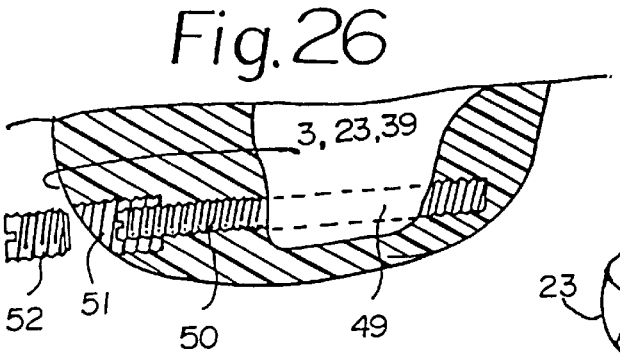
FIG. 26 is an enlarged cross-sectional view of a threaded cylindrical cavity, threaded weight and a threaded cap employed in the embodiment viewed in FIG. 23, FIG. 24 and FIG. 25.
Figure 25:
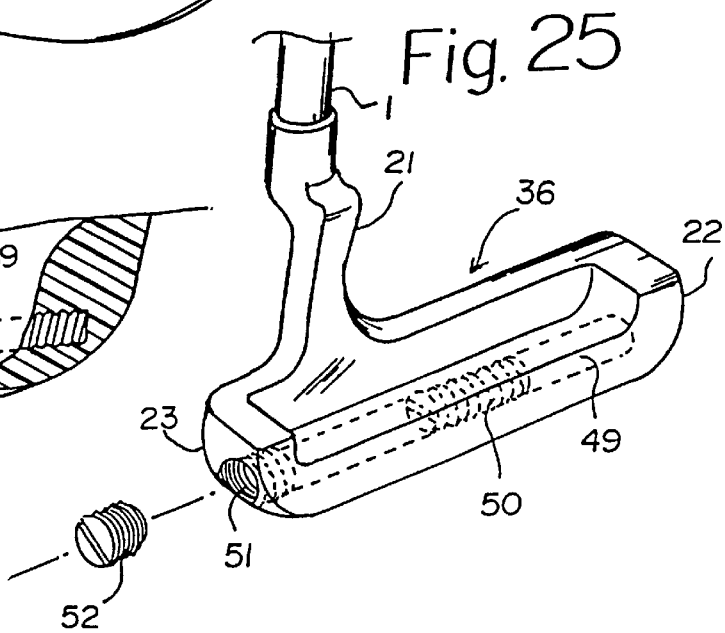
FIG. 25 is a perspective view of putter head made in accordance with the seventh embodiment of the present invention.

Another embodiment to provide the adjustable feature of the center of gravity, club head weight, and weight distribution to the golf clubs of iron 2, wood 37, and putter 36 is illustrated in FIGS. 23–26. The club heads of aforementioned clubs are provided with a cylindrical cavity 49 longitudinally drilled from rear to front and tapped with thread. FIG. 23 illustrates an iron club head 2 showing location of the threaded hole 49. Similarly, FIG. 24 and FIG. 25 illustrate location of the hole cavity 49 in a wood club 37 and a putter 36, respectively. FIG. 26 is an enlarged view of the threaded cylindrical cavity 49, a weight 50, and a cap 52 for the cylindrical cavity. A threaded rod resembling a set screw serves as an adjusting weight 50 is screwed into the threaded cylindrical cavity 49. Depending on the adjustment needed, the threaded weight 50 can be moved in and out of the threaded cylindrical cavity. With this device, infinite number of adjustments can be made to vary the center of gravity of a club as well as the weight distribution of a club. In addition, the weight of a club can be altered by substituting the threaded weight 50 with a new weight of different size and density. The entire adjusting mechanism including the threaded cylindrical cavity 49 and the threaded weight 50 can be sealed and protected from outside elements such as dirt and soil with a capping screw 52 of slightly larger diameter 51 than the main threaded cavity 49. The screw head of the cap 52 may be of an unconventional design so that a special tool that fit the screw head must be used to open the cavity for any adjustment operation. This type of protection is provided to prevent an unwanted tampering of the adjusting weight 50 by a person other than the owner.

While the preferred embodiments described herein set forth the best mode to practice this invention presently contemplated by the inventors, numerous modification and adaptations of this invention will be apparent to others skilled in the art. Therefore, the embodiments are to be considered as illustrative and exemplary and it is understood that the claims are intended to cover such modifications and adaptations as they are considered to be within the scope of the invention.

What is claimed is:

1. A golf club head having an adjustable center of gravity, said golf club head having a heel portion, a toe portion, a striking surface and a rear surface, said golf club head comprising:

a bottom portion extending rearwardly of said striking surface and having a slot formed therein and a top portion extending rearwardly of said striking surface and having a groove formed therein each of said slot and said groove extending generally horizontally between said heel and toe portions;

an elongated weight having a top end shaped for sliding engagement with said groove and a bottom end having a rearwardly extending portion for sliding engagement within said slot;

a disc shaped central portion formed in said weight and having a central bore formed therein, said central bore being threaded for threaded engagement with a set screw, said screw having a length extending into and through said bore and putting sufficient force on said rear surface to lock said weight into a desired horizontal position along said rear surface, whereby the location of the center of gravity may be selectively adjusted.

2. The golf club head of claim 1 wherein said weight terminates at said disc shaped portion.

3. A golf club head having an adjustable center of gravity, said golf club head having a heel portion, a toe portion, a striking surface and a rear surface having a predetermined width, said golf club head comprising:

a bottom portion extending rearwardly of said striking surface and having a slot formed therein and a top portion extending rearwardly of said striking surface and having a groove formed therein;

an elongated weight having a top end shaped for sliding engagement with said groove and a bottom end having a rearwardly extending portion for sliding engagement within said slot;

said groove and said slot co-extending between said heel and said toe and allowing positioning of said weight at substantially the entire width of said rear surface;

at least one elongated horizontally disposed permanent magnets secured to said rear surface, said magnets capable of generating sufficient magnetic force to hold said weight in a desired horizontal position during impact with a golf ball.

* * * * *